US006059303A

United States Patent [19]

Bradfield

[11] Patent Number: 6,059,303

[45] **Date of Patent: *May 9, 2000**

[54] IN-LINE SKATEBOARD

[76] Inventor: Athol George Bradfield, Box 48226, Bentall 3, Vancouver, B.C., Canada, V7X 1N8

[ * ] Notice: This patent is subject to a terminal disclaimer.

[21] Appl. No.: 09/177,803

[22] Filed: Oct. 23, 1998

Related U.S. Application Data

[63] Continuation-in-part of application No. 08/955,740, Oct. 22, 1997, Pat. No. 5,826,895, which is a continuation of application No. 08/561,336, Nov. 21, 1995, Pat. No. 5,707,068.

[51] Int. Cl.[7] ..... A63C 17/04

[52] U.S. Cl. ..... 280/87.042; 280/11.28

[58] Field of Search ..... 280/11.19, 11.22, 280/11.27, 11.28, 842, 843, 87.041, 87.042

[56] References Cited

U.S. PATENT DOCUMENTS

| | | |
|---|---|---|
| 2,064,690 | 12/1936 | Schavone . |
| 3,252,713 | 5/1966 | Heller . |
| 3,622,172 | 11/1971 | Goodwin . |
| 3,862,763 | 1/1975 | Ware . |
| 4,047,727 | 9/1977 | Holladay et al. . |
| 4,061,350 | 12/1977 | Schmidt, Jr. et al. . |
| 4,062,557 | 12/1977 | Roden . |
| 4,109,925 | 8/1978 | Williams et al. . |
| 4,152,001 | 5/1979 | Christianson . |
| 4,180,278 | 12/1979 | Gottlieb . |
| 4,382,605 | 5/1983 | Hegna . |
| 4,978,140 | 12/1990 | Babson . |
| 5,096,225 | 3/1992 | Osawa . |
| 5,125,687 | 6/1992 | Hwang . |
| 5,135,244 | 8/1992 | Allison . |
| 5,160,155 | 11/1992 | Barachet . |
| 5,263,725 | 11/1993 | Gesmer et al. . |
| 5,419,570 | 5/1995 | Bollotte . |
| 5,540,455 | 7/1996 | Chambers . |
| 5,549,331 | 8/1996 | Yun et al. . |
| 5,551,713 | 9/1996 | Alexander . |
| 5,553,874 | 9/1996 | Schouten et al. . |
| 5,660,401 | 8/1997 | Yi . |

FOREIGN PATENT DOCUMENTS

| | | |
|---|---|---|
| 0110489 | 6/1984 | European Pat. Off. . |
| 9204746 | 6/1992 | Germany . |
| 29508825 | 9/1995 | Germany . |
| 8903712 | 5/1989 | WIPO . |

OTHER PUBLICATIONS

Armstrong, Gazette entry for U.S. Patent No. 4,795,181, date unknown.

Shols, Gazette and abstract for U.S. Patent No. 4,886,289, issued Dec. 12, 1989.

*Primary Examiner*—Michael Mar

*Attorney, Agent, or Firm*—Shlesinger, Arkwright & Garvey LLP

[57] ABSTRACT

A skateboard has a plurality of in-line wheels rotatably mounted on the front end of the board and rear wheels disposed on either side of the rear end of the board. The left and right rear wheels are mounted incurvate with respect to the board and the in-line wheels to provide incurvated rear wheel steering for the board. The board may have a resiliently flexible portion between the in-line and rear wheels. The in-line wheels may be supported between a pair of parallel lateral flanges or they may be supported on a single flange that splits each in-line wheel. The rear wheels may be mounted on a coil and leaf spring suspension, on a transverse shaft or in housings at the rear end of the board. The rear wheels may be tapered.

5 Claims, 4 Drawing Sheets

IN-LINE SKATEBOARD

This is a continuation-in-part of application Ser. No. 08/955,740, filed Oct. 22, 1997, which is to issue as U.S. Pat. No. 5,826,895, on Oct. 27, 1998, which was itself a continuation of application Ser. No. 08/561,336, filed Nov. 21, 1995, which issued as U.S. Pat. No. 5,707,068 on Jan. 13, 1998.

TECHNICAL FIELD

The invention is in the field of skateboards. More particularly, the invention relates to the arrangement of wheels on skateboards.

BACKGROUND ART

It is generally accepted that the recreational sport of skateboarding developed as an offshoot of surfing sometime in the late 1960s. As such, the skateboard was, and still is, intended to provide a similar athletic experience to surfing. In recent years, the sport of skateboarding has become popular throughout the industrialized words. This acceptance of the sport is due in large part to technological developments which have improved the ride and handling of skateboards so that they better approximate the smooth side of a surfboard on water.

In its most common current form, a skateboard typically includes a board 6–12 inches wide and 2–3 feet long. Boards are often made of wood or fibreglass. Two sets of two polyurethane wheels are typically mounted on the bottom side of the board, one set of wheels being attached towards the front end of the board, the other set of wheels being attached towards the rear end of the board. Such set of wheels is typically mounted on an axle in a pivoting truck assembly. The truck resiliently pivots about its connection with the board and thereby displaces the axle from its usual orientation perpendicular to the median longitudinal axis of the skateboard. The axles are displaced by tilting the board so that the axles each come to lie on a radius of a circle, thereby orienting the wheels so that they steer the skateboard along the circumference of the circle. This arrangement of wheels provides favourable cornering characteristics along with stability, enabling skilled skateboarders to negotiate smooth, sharp turns in rapid succession.

At one time, roller skates were commonly provided with trucks similar to the trucks found nowadays on most skateboards. Typically, roller skates of this design had two sets of two wheels mounted on pivoting trucks, with the four wheels being disposed essentially at the corners of a rectangle. This old design has given way in popularity recently to an in-line roller blade configuration, with a plurality of wheels arranged along the median longitudinal axis of the roller skate. An in-line arrangement of wheels provides for more speed and manoeuvrability than the rectangular arrangement of wheels on pivoting trucks. However, the in-line configuration naturally sacrifices a degree of stability to achieve improved manoeuvrability.

A variety of skateboard designs have appeared in which an in-line wheel configuration has been adopted. U.S. Pat. No. 5,419,570 issued May 30, 1995, to Bollotté discloses a skateboard having in-line wheels. U.S. Pat. No. 4,382,605 issued May 10, 1983 to Hegna discloses an arrangement of steerable in-line wheels that may be adapted for use on a skateboard. Similarly, U.S. Pat. No. 3,622,172 issued Nov. 23, 1971 to Turf Ski, Inc. shows a land skier with a plurality of in-line ball bearing rollers. The disadvantage of reduced stability that characterizes in-line roller blade skates is accentuated when an in-line configuration is used on a skateboard. With roller blade skates, a user is at least able to balance on two skates that are laterally disposed. With an in-line skateboard, there is no such opportunity to off-set the inherent instability of an in-line design.

There is a need for a skateboard design that combines the speed and manoeuvrability of an in-line wheel arrangement with the handling and stability of laterally disposed wheels. It would be advantageous if such a design exhibited handling characteristics that better mirrored the handling of surfboard on water.

DISCLOSURE OF INVENTION

In accordance with the invention, a skateboard includes a board, a plurality of in-line wheels and at least two rear wheels. The in-line wheels are rotatably mounted on the bottom side of the board, towards the front end of the board, and are arranged longitudinally along the median longitudinal axis of the board. A first rear wheel is rotatably mounted behind the in-line wheels on the left side of the board towards the rear end of the board. A second rear wheel is rotatably mounted behind the in-line wheels on the right side of the board towards the rear end of the board. The skateboard can roll over a surface on one or more of the wheels and the skateboard is steerable when its rolling by tilting the board about the median longitudinal axis. The skateboard may be steered to the left by tilting the left side of the board downwards. Similarly, the skateboard may be steered to the right by tilting the right side of the board downwards. The in-line wheels and the first wheel come into contact with the surface when the skateboard steers to the left and, similarly, the in-line wheels and the second wheel may come into contact with the surface when the skateboard steers to the right.

A portion of the skateboard may be resiliently flexible, to allow the board to bend about a transverse axis. The resiliently flexible portion of the board that allows this flexibility may be between the part of the board where the in-line wheels are mounted and the part of the board where the rear wheels are mounted. The resiliently flexible portion of the board may be made of a transverse hinge mounted in the board connecting the front and rear ends of the board.

The rear wheels of the board may be tapered so that they are wider near the median longitudinal axis of the board than they are further from that axis. In other words, the outer circumference of the wheels may be smaller than the inner circumference of the wheels.

The rear wheels of the skateboard may be mounted higher off the ground that the in-line wheels. In effect, the horizontal plane that is tangential to the lowest circumferential surface of the left and right rear wheels may be above the horizontal plane that is tangential to the lowest circumferential surface of the in-line wheels.

The wheels may be mounted on a leaf and coil spring suspension. The front end of the leaf spring may be attached to the rear wheels and to the coil spring.

The parts of the skateboard may be sold individually or together as a kit with instructions for making a skateboard in accordance with the invention. In particular, the in-line wheel assembly can be sold in a package with labelling that indicates that the in-line wheel assembly can be mounted on a skateboard. The in-line wheel assembly may be sold this way with a frame that is adapted for mounting the in-line wheel assembly on a planer surface, such as a skateboard.

BEST MODE(S) FOR CARRYING OUT THE INVENTION

Figure 1:
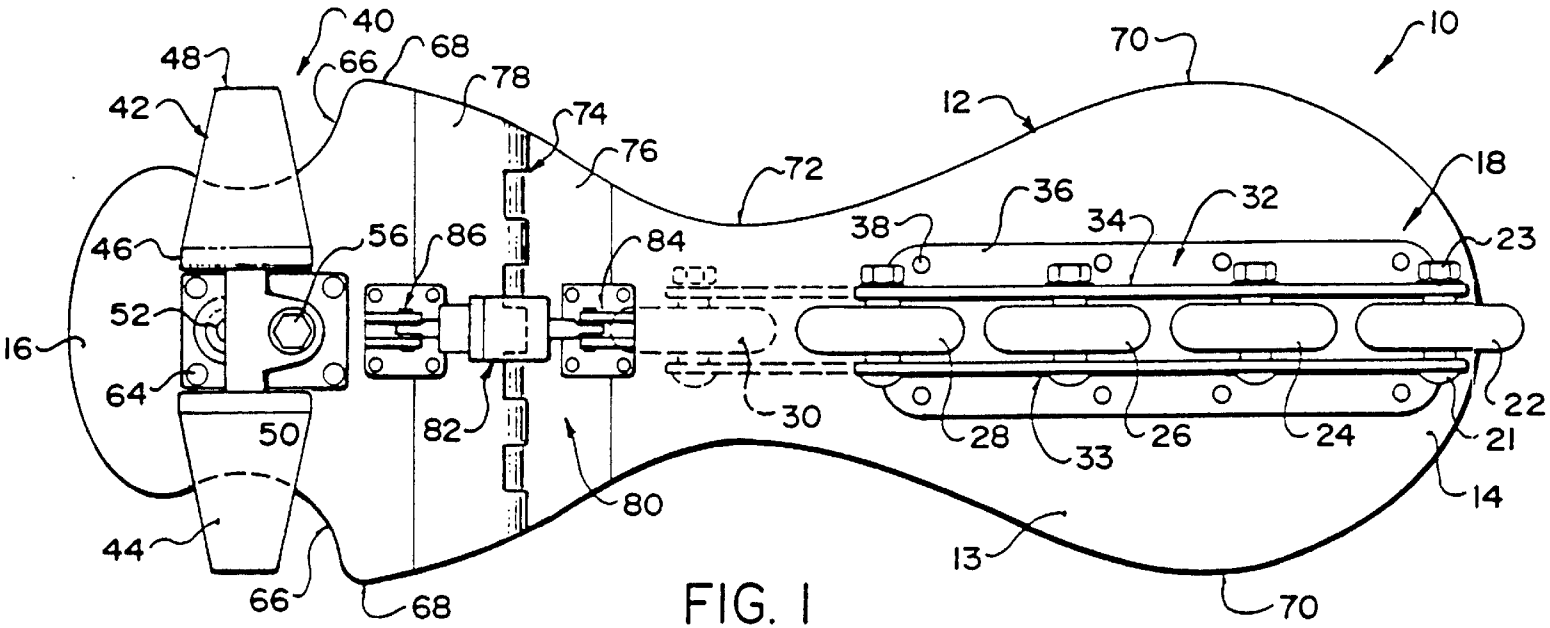
FIG. 1 is a bottom plan view showing a skateboard of the invention with an in-line wheel assembly and a rear wheel assembly.
Figure 2:
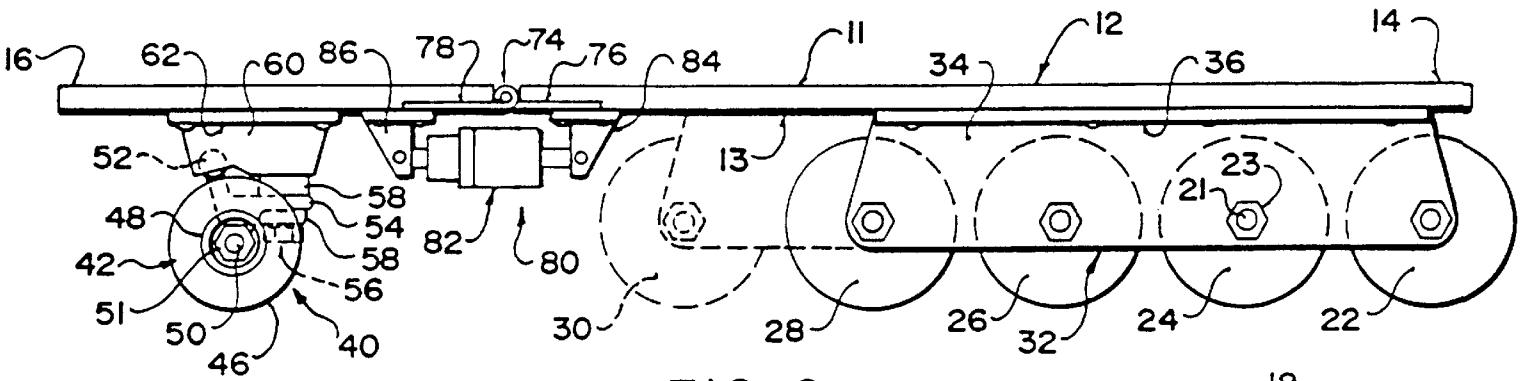
FIG. 2 is a side elevation view showing the skateboard of FIG. 1.

FIGS 1 and 2 show skateboard 10 comprised of board 12, in-line wheel assembly 18 and rear wheel assembly 40. A hinge 74 connects the front end 14 and rear end 16 of board 14. A resilient housing 82 supports board 12 in the area of hinge 74. In this description, the left and right sides of skateboard 10 are as viewed looking down from the top side of the board and towards the front end of the board.

Supporting frame 32 of in line wheel assembly 18 is comprised of plate 36 and downwardly depending flanges 34, 33. Frame 32 is fastened to the bottom side 13 of the front end 14 of board 12 by bolts 38. Apertures (not shown) in downwardly depending flanges 34, 33 support axle bolts 21 which are secured by axle nuts 23. Wheels 22, 24, 26 and 28 are rotatably mounted on axle bolts 21 and disposed longitudinally along the median longitudinal axis of board 12. In-line wheels 22, 24, 26, 28 may be mounted on axes that are fixed perpendicularly to the median longitudinal axis of board 12. An alternative fifth in-line wheel 30 is shown by phantom lines in FIGS. 1 and 2.

Integral body 60 and plate 62 of rear wheel assembly 40 are attached by bolts 64 to the rear end 16 of board 14. Integral pivoting member 52, flange 54 and axle 50 are fastened to body 60 by bolt 56 which passes through an aperture in flange 54 and is threadably received in body 60. The upper end of pivoting member 52 is received in a socket in body 60. Resilient rings 58 are mounted on bolt 56 on either side of flange 45, resiliently biasing pivoting member 52 and flange 54 in place in body 60.

Rear wheels 44, 48 are removably secured on axle 50 by wheel nuts 51. Rear wheel 42 is rotatably mounted behind in-line wheels 22, 24, 26 and 28 on the right side towards the rear end 16 of board 12. Rear wheel 44 is rotatably mounted behind in-line wheels 22, 24, 26 and 28 on the left side towards the rear end 16 of board 12. Rear wheels 44, 48 may have an inner flat portion 46 and may be tapered outwardly towards outer portion 48, so that the circumference of the portion of the wheel closest to the median longitudinal axis of board 12 is greater than the circumference of the portion of the wheel furthest from that axis.

In one embodiment, the rear wheel assembly steerably mounting the pair of rear wheels to the rear portion of the board comprises a skateboard truck in which axle 50 pivots about pivoting member 52 and a support member 56. Pivoting member 52 is pivotably mounted to the bottom side of the board 12 rearwardly of the support member 56. The support member 56 may be fixed to the bottom side of the board by body 60. The axis of rotation of the rear wheels (about axle 50) is rotatable about the support member 56 in the plane of the riding surface 15. The rear wheel assembly 40 is operatively coupled to the rear portion 16 of the board 12 so that when the board is moving along the riding surface, tilting the left side of board 12 downwards causes the rear wheels 44, 48 to steer board 12 to turn to the left, and tilting the right side of board 12 downwards causes rear wheels 44, 48 to steer the board to turn to the right.

Figure 3:
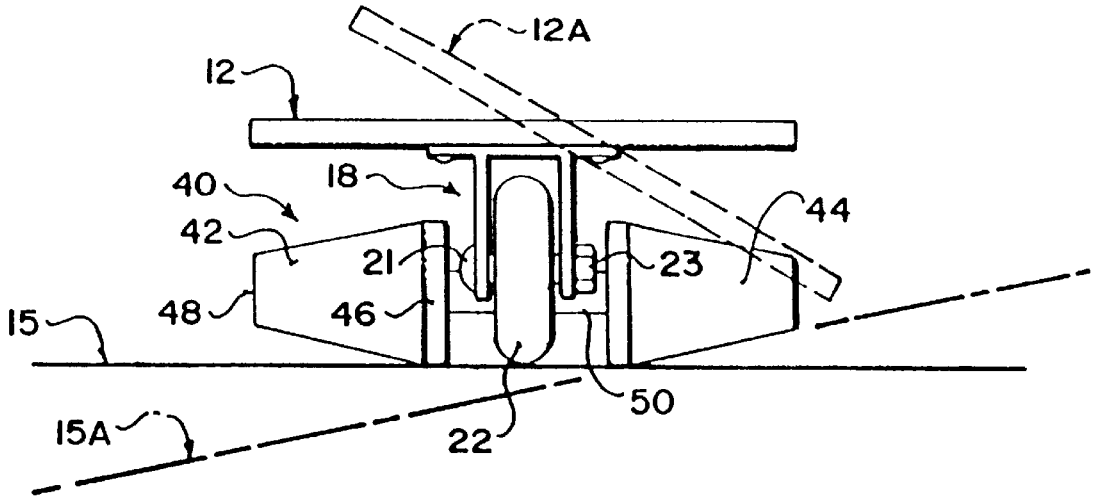
FIG. 3 is a front elevation view of the skateboard of FIGS. 1 and 2, showing the skateboard tilted in a turn.

Tilting board 12, as shown in FIG. 3 by dashed lines 12A, causes axle 50 to rotate in a horizontal plane about the axis of bolt 56 while pivoting member 52 swivels in the socket (now shown) in body 60. The rotational displacement of axle 50 steers skateboard 10 by turning rear wheels 42, 44. Tilting the left side of board 12 downwards causes skateboard 10 to turn to the left. Similarly, Tilting the right side of board 12 downwards causes skateboard 10 to turn to the right. FIG. 3 shows ground plane 15.

One example of a skateboard truck that may be used in the present invention is shown in U.S. Pat. No. 3,862,763 issued Jan. 28, 1975 to Ware, and incorporated herein by reference. Such trucks function essentially as described above, with a pivot arm, such as pivoting member 52, attached at one end to the center portion of the wheel axle 50. The other end of the pivot arm being fitted, at an angle of approximately 45°, into a plastic cup mounted in a baseplate, such as body 60, forming a ball-like joint. The support member 56 (or king pin) may be mounted substantially vertically in the body 60 (or baseplate). Ring-shaped flange 54 extends from the housing of axle 50 to engage the support member 56, so that axle 50 is suspended between the ball-like joint and the resilient rings 58 (or grommets, which may be made of rubber or urethan). As described above, such an arrangement of truck parts causes the rear wheel on the inside of a turn radius to move upwardly and inwardly, i.e. incurvate, with respect to board 12 and in-line wheel assembly 18 when board 12 is tilted into a turn. This contrasts with the opposite rear truck arrangement disclosed in U.S. Pat. No. 5,551,713 issued Sep. 3, 1996 to Alexander, in which the rear wheels move outwardly and upwardly during turning, rather than incurvating.

alternative steerable rear truck designs may also be used in accordance with various aspect of the invention to provide rear wheels that incurvate to steer the board. This incurvating action provides a steering mechanism which is similar to the steering mechanism of a surf board, in which left and right rear fins are angled to steer the surf board through turns. For example, U.S. Pat. No. 5,263,725 issued Nov. 23, 1993 to Gesmer at al., and incorporated herein by reference, discloses a skateboard truck assembly that may provide incurvating rear wheels for the skateboard of the present invention. In the Gesmer et al. truck design, a yoke containing the truck axle rotates about a pivot pin that engages a baseplate on the board. Coil springs mounted between the yoke and the baseplate facilitate the controlled pivotal movement of the wheels about the axis of the pivot pin, allowing the inside rear wheel to incurvate to steer the board through a turn.

Other rear truck designs that may be used to provide incurvating wheel movement are disclosed for example in the following U.S. Patents, which are incorporated herein by reference: U.S. Pat. No. 4,061,350 issued Dec. 6, 1977 to Schmidt, Jr. et. al; U.S. Pat. No. 4,109,925 issued Aug. 29, 1978 to Williams et al.; U.S. Pat. No. 4,180,278 issued Dec.

25, 1979 to Gottlieb. The trucks disclosed therein generally operate based on a 'torsion bushing' principle, in which the wheel axle is supported on an angled support member, analogous to pivoting member 52, about which the axle can rotate with resilient resistance to provide an incurvating rear wheel steering motion.

The combination of front in-line wheel assembly 18 with laterally disposed rear wheels 42, 44 provides the skateboard of the present invention with surprising handling characteristics. The in-line wheel assembly 18 imparts improved lateral stability to skateboard 10 in turns, so that skateboard 10 is less likely to "break away" from the turn. At the same time, rear wheels 42, 44 impart a degree of stability to skateboard 10 and facilitate turning by their steerable facility.

When board 12 is tilted sharply to one side, the tapered surface of the rear wheel on that side may come into engagement with the surface upon which skateboard 10 is riding, as shown by ground plane 15A in FIG. 3. In this way, the taper of rear wheels 42, 44 assists a rider in making sharp turns by ensuring that a large surface of the rear wheel is in contact with the surface at the sharpest part of a turn.

Hinge 74 is adhesively attached to board 12 by plates 76, 78. Hinge 74 allows skateboard 10 to flex under pressure. The extent of flex about hinge 74 is moderated by resilient coupling 82 which is mounted to board 12 by brackets 84, 86 on either side of hinge 74. The resilient flex of board 12 about hinge 74 acts as a shock absorber and assists in keeping the wheels of this embodiment on the ground at all times.

As shown in FIG. 1, a narrow waist portion 72 of board 12 may be formed by converging rear side edges 68 and front side edges 70. A narrow waist portion 72 of board 12 may serve a similar function as resiliently biased hinged 74. It will be appreciated that the dimensions and materials of board 12 may be varied in a number of ways in order to achieve a similar result. For example, the thickness of board 12 may be varied in the vertical dimension to modulate the flexibility of portions of board 12. Alternatively, the whole board may be constructed of a material which permits flexibility in the region of board 12 between in-line wheel assembly 18 and rear wheel assembly 40. The engagement of the in line wheel assembly plate 36 and the rear wheel assembly body plate 62 may, respectively, lend the front 14 and rear 16 portions of board 12 greater stiffness than an intermediate portion of board 12, permitting pivotal movement of the front 14 and rear 16 portions of board 12 with respect to one-another about the intermediate transverse position of board 12. Such pivotal flexibility in board 12 may help to keep in-line wheels 22, 24, 26, 28 engaged with the riding surface when travelling over undulating terrain or negotiating tight turns.

Figure 4:
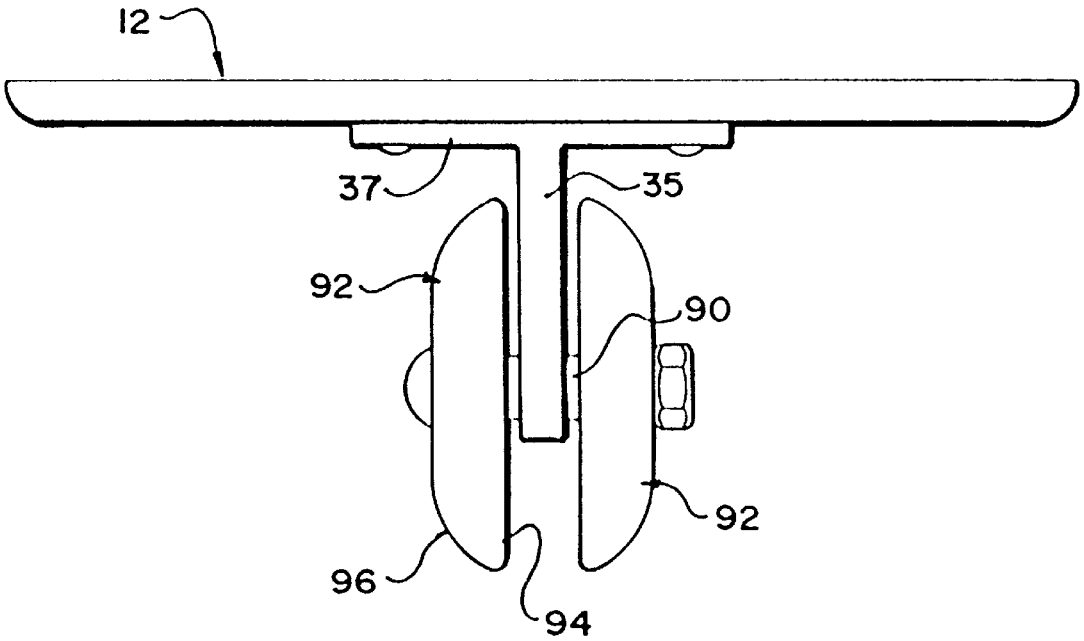
FIG. 4 is a front elevation view of a skateboard of the invention showing a split wheel in-line wheel assembly.

FIG. 4 shows a front view of an alternative in-line wheel assembly in which rigid vertical flange 35 depends downwardly from horizontal plate 37. Axles 90 are supported by flange 35. Pairs of split wheels 92 with vertical inner faces 94 and curved outer edges 96 are rotatably mounted on axles 90. This alternative split wheel 92 may facilitate making sharp turns with skateboard 10, since there are no downwardly depending flanges 34, 33 on the lateral sides of the in-line wheels (as there are in the embodiment of FIGS. 1 and 2). The curved outer edges 96 of split wheels 92 also facilitate turning because they tend to maintain a constant degree of contact with a surface as board 12 tilts into a turn.

Figure 5:
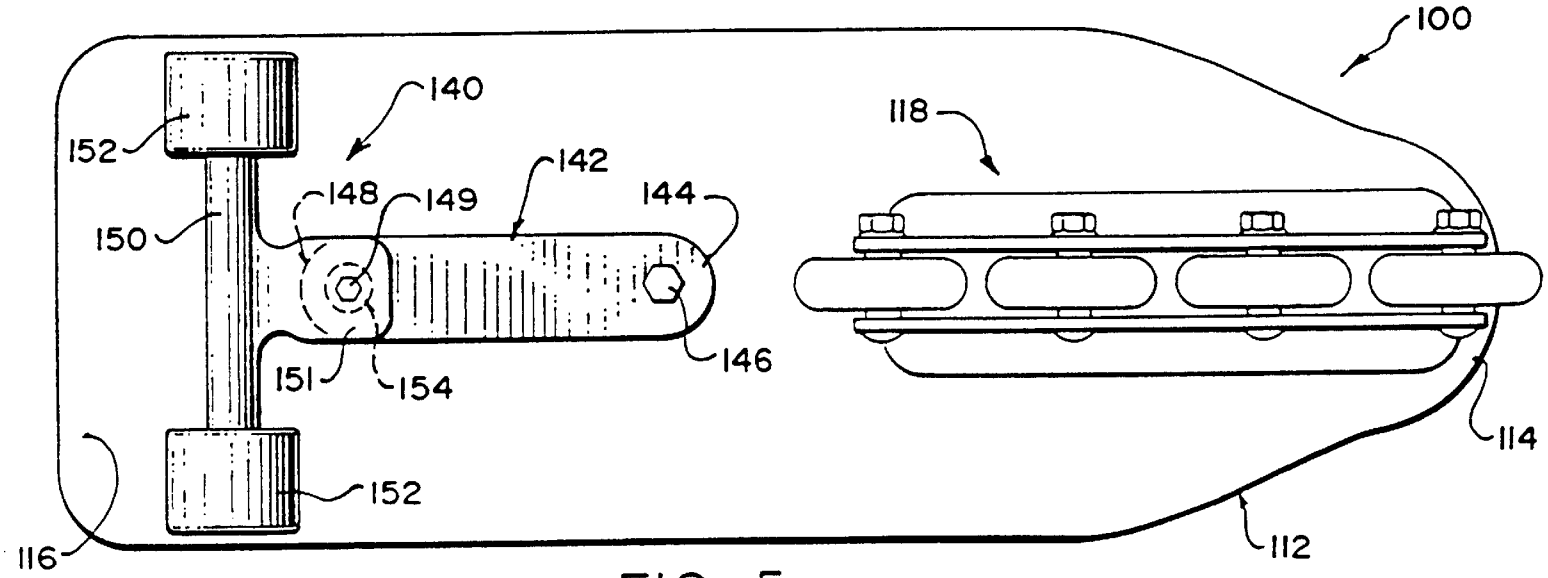
FIG. 5 is a bottom plan view of an alternative skateboard of the invention showing a rear wheel assembly with a leaf spring and coil spring suspension.
Figure 6:
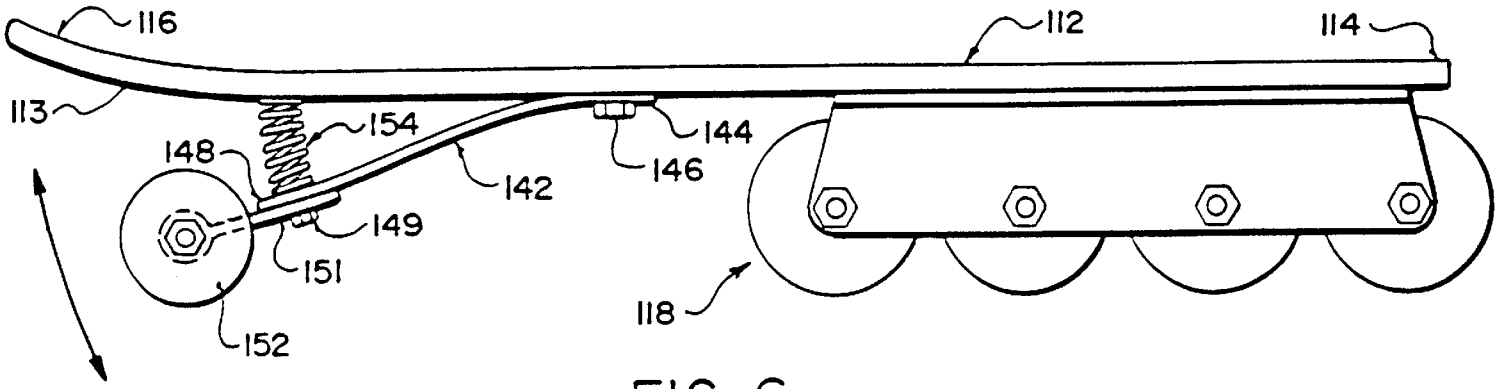
FIG. 6 is a side elevation view showing the skateboard of FIG. 5.

FIGS. 5 and 6 show an alternative embodiment in which rear wheel assembly 140 is attached to board 112 by leaf spring 142. Outer end 148 of leaf spring 142 is biased away form rear portion 116 of board 112 by coil spring 154. Inner end 144 of leaf spring 142 is attached to the central portion of the bottom side 113 of board 100 by bolt 146 (or other fastening means). Axle 150 is rigidly affixed to axle plate 150. Wheels 152, axle 150 and axle plate 151 may pivot about the vertical axis of bolt 149 to assist in steering skateboard 100. Resilient pivot stop means, not shown, may be used to maintain the pivotal alignment of axle plate 151. The coil spring 154 and leaf spring 142 allow rear wheel assembly 140 to travel vertically. This capacity for shock absorption helps to ensure that as many wheels as possible remain in contact with the surface over which skateboard 100 travels.

Figure 7:
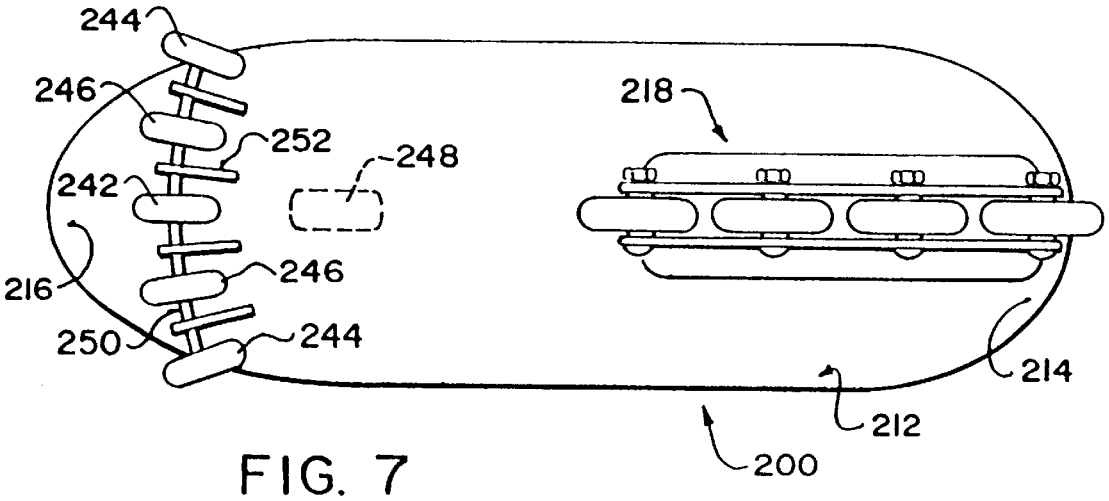
FIG. 7 is a bottom plan view showing an alternative skateboard of the invention showing a rear wheel assembly with a plurality of wheels disposed on a shaft.
Figure 8:
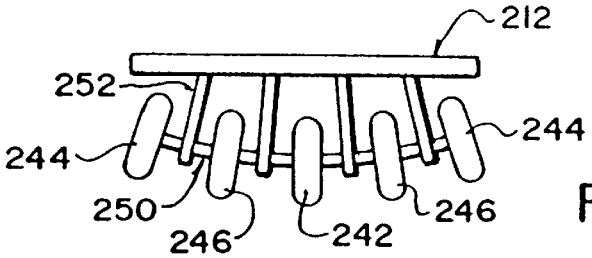
FIG. 8 is a rear elevation view of the skateboard of FIG. 7.

FIGS. 7 and 8 show an alternative embodiment of skateboard 200 with in-line wheel assembly 218 mounted towards the front end 214 of board 212. Rear wheel assembly 240 mounted towards the rear end 216 of board 212 comprises a plurality of spaced apart wheels 242, 244 and 246 disposed on shaft 250. Shaft 250 is supported on radial members 252 depending downwardly from the rear end 216 of board 212.

As shown in rear elevation if FIG. 8, shaft 250 is adapted to arrange wheels 242, 244 and 246 along the circumference of a curve, with outer wheels 244 being closer to board 212 than intermediate wheels 246. Intermediate wheels 246 are in turn closer to board 212 than central wheel 242. As shown in FIG. 7, when viewed in plan, the rotational axes of wheels 242, 244 and 246 are different. The rotational axis of out wheels 244 is more oblique to the longitudinal axis of skateboard 200 than are the rotational axes of intermediate wheels 246. The rotational axis of central wheel 242 is perpendicular to the longitudinal axis of skateboard 200. The disposition of wheels 242, 244 and 246 is such that skateboard 200 may be steered by tilting board 212. Outer wheels 244 provide for a greater degree of turn than intermediate wheels 246. Central wheel 242 is aligned with in-line wheel assembly 218 so that skateboard 200 will tend to travel in a straight lien when it is not tilted. An alternative central wheel 248 is shown by phantom lines in FIG. 7. It will be appreciated that intermediate wheels 246 may be dispensed with or a greater number of such wheels may be added, depending on the desired characteristics of board 200.

It will be appreciated that the rear wheel arrangement shown in FIGS. 7 and 8 provides left and right wheels 246, 244 that are in effect incurvated with respect to board 212 and. This assembly thereby provides an incurvated rear wheel steering mechanism, as is also provided by the trucks with movable incurvating wheels discussed above.

Figure 9:
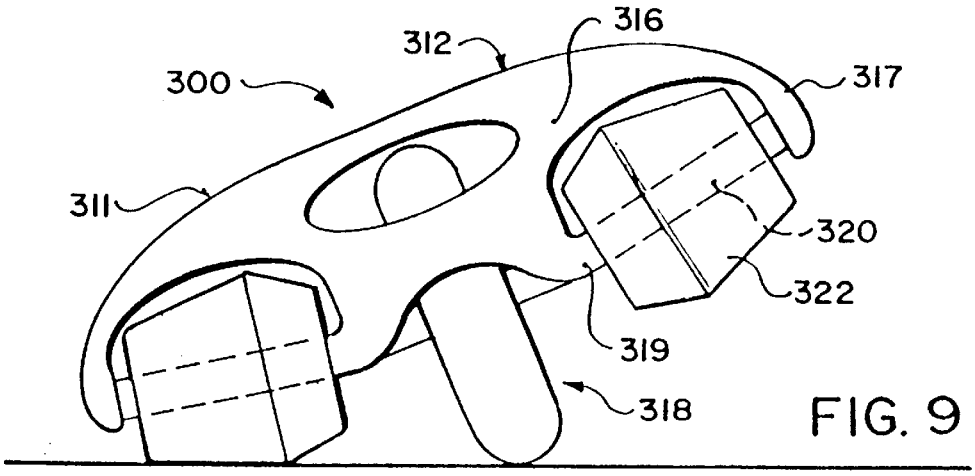
FIG. 9 is a rear elevation view of an alternative skateboard of the invention showing rear wheels mounted on axels in a housing.

FIG. 9 shows an alternative skateboard 300 with an in-line wheel assembly 318 mounted towards front end 314 of board 312. Integral outer axle supports 317 depend downwardly from the rear end 316 of board 312. Axles 320 are mounted in axle supports 317. Rear wheels 322 are rotationally mounted on axles 320 within integral housings formed by the rear end 316 of board 312. The horizontal plane that is tangential to the lowest circumferential surface of the left and right rear wheels 320 is above the horizontal plane that is tangential to the lowest circumferential surface of the in-line wheels 318. Rear wheels 322 are incurvated with respect to board 312 and in-line wheel assembly 318, to provide incurvated rear-wheel steering of board 312.

It will be appreciated that the components of the skateboard of the invention may be sold individually or as a package along with instructions for assembling a complete skateboard of the invention. In particular, in-line wheel assembly 18 comprising frame 32 mountable on a planar surface may be sold in packaging which indicates that wheel assembly 18 may be mounted on a skateboard.

In an alternative embodiment, the first and second rear wheels may be mounted on a single axle with a third wheel interposed between the first and second wheels on the axle. The axle may in turn be supported at each of its ends on a single pivoting truck. An example of an arrangement of this type is provided in U.S. Pat. No. 4,047,727, issued Sep. 13, 1977 to Holladay et al., which is incorporated herein by reference.

In an alternative embodiment, the invention may be adapted for use on a large board fitted with a windsurfer sail. In such an embodiment, the wheels may be fitted with pneumatic tires rather than solid tires. The combination of the forward in-line wheels with the left and right rear wheels may provide a ride for such a land windsurfer that simulates the ride of a windsurfer on water.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A skateboard comprising:

a board having a front end, a rear end, a top side, a bottom side, a left side, a right side and a median longitudinal axis running from the front end to the rear end dividing the left and right sides;

a plurality of in-line wheels rotatably mounted on fixed axes on the bottom side towards the front end of the board, the in-line wheels being longitudinally disposed along the median longitudinal axis of the board;

a first incurvating rear wheel rotatably mounted behind the in-line wheels on the left side towards the rear end of the board;

a second incurvating rear wheel rotatably mounted behind the in-line wheels on the right side towards the rear end of the board; and wherein the first and second incurvating rear wheels are operably coupled to the board to incurvate with respect to the board and the in-line wheels to co-operate with the in-line wheels to steer the board to the left or to the right respectively when the skateboard rolls over a surface, the skateboard being steerable to the left by tilting the left side of the board downwards to steeringly engage the first incurvating rear wheel with the surface, and steerable to the right by tilting the right side of the board downwards to steeringly engage the second incurvating rear wheel with the surface.

2. The skateboard of claim 1 wherein the plurality of in-line wheels are mounted to a first portion of the board, the first and second rear wheels are mounted to a second portion of the board and the board further comprises a transverse portion that is disposed longitudinally between the first and second portions of the board, wherein the transverse portion of the board is more resiliently flexible than are the first and second portions of the board.

3. The skateboard of claim 2 wherein the transverse portion comprises a transverse, resiliently biased hinge connecting the front end and the rear end of the board.

4. The skateboard of claim 1 wherein the first and second rear wheels each have an inner circumference and an outer circumference, the inner circumference being closer than the outer circumference to the median longitudinal axis of the board, wherein the first and second rear wheels are tapered so that the outer circumference of the wheel is smaller than the inner circumference of the wheel.

5. The skateboard of claim 1 wherein the in-line wheels each have an inner circumference and outer circumferences, the inner circumferences being closer than the outer circumferences to the median longitudinal axis of the board, wherein the in-line wheels are tapered so that the outer circumferences of the wheels are smaller than the inner circumference of the wheels.

* * * * *